United States Patent [19]

Seitzer

[11] 4,192,650

[45] Mar. 11, 1980

[54] PROCESS FOR DRYING AND STABILIZING COAL

[75] Inventor: Walter H. Seitzer, West Chester, Pa.

[73] Assignee: Sunoco Energy Development Co., Dallas, Tex.

[21] Appl. No.: 925,575

[22] Filed: Jul. 17, 1978

[51] Int. Cl.[2] ..... C10L 5/00

[52] U.S. Cl. ..... 44/1 R; 44/1 G; 34/10

[58] Field of Search ..... 44/1 G, 1 R, 10 D, 10 E; 34/10, 12

[56] References Cited

U.S. PATENT DOCUMENTS

| | | | |
|---|---|---|---|
| 2,610,115 | 9/1952 | Lykken | 44/33 |
| 3,723,079 | 3/1973 | Seitzer | 44/1 R |
| 3,800,427 | 4/1974 | Kemmetmueller | 34/10 |
| 3,896,557 | 7/1975 | Seitzer et al. | 34/10 |
| 3,992,784 | 11/1976 | Verschuur et al. | 34/12 |
| 4,043,763 | 8/1977 | Norman et al. | 44/1 G |

*Primary Examiner*—Carl F. Dees

*Attorney, Agent, or Firm*—J. Edward Hess; Donald R. Johnson; Paul Lipsitz

[57] ABSTRACT

A process for stabilizing lignitic and subbituminous coal containing from about 25 to about 40% by weight water which comprises treating said dried coal with steam at a temperature of from about 100° C. to about 115° C. so as to enable said coal to be rehydrated to a moisture level of from about 2% to about 10% by weight whereby said coal is stabilized against spontaneous combustion.

5 Claims, No Drawings

PROCESS FOR DRYING AND STABILIZING COAL

Lignitic and subbituminous coals are received from the mine containing from about 25 to about 40% internal moisture and such coals are usually subjected to a drying procedure before shipment and use. Numerous types of equipment and techniques for such coal drying are available and have been used for some time. In general, a hot combustion gas is used to drive moisture from the coal and this is done either by passing such gases through a bed of the coal, often a fluidized bed, or by passing the coal through a kiln or other rotary device while the gases are passed through. A particularly useful commercial device for such coal drying is the Parry Dryer (see U.S. Pat. No. 2,666,269) which employs the hot combustion drying gases to fluidize the coal. In commercial use the combustion gases are usually obtained from coal or fuel oil and the fuel-air ratio is maintained so that the combustion gases contain about 5 percent by volume of oxygen.

One of the characteristics of dried coal is its tendency toward spontaneous combustion and this becomes a serious problem during the shipment and storage of such coal. Coal subjected to the above described drying process is somewhat improved in its spontaneous combustion character, but additional stability is still desired in order to further mitigate or eliminate the fire hazard present in shipping and storing dried coal.

It is known in the art (U.S. Pat. No. 2,610,115) that when lignitic fuels containing 25% to 40% water are dried to a moisture content below 10% to 15% that moisture will be reabsorbed. This patent also discloses the treatment of lignitic fuels with superheated steam above 300° F. (155° C.) and a hydrocarbon to provide a dust-free coal which is free from spontaneous combustion. The coal so treated has a lesser tendency to absorb gases and oxygen particularly, than does lignitic coal which is produced without hydrocarbon vapors being present during the treating period.

A method for drying lignitic and subbituminous coal to impart stabilization against spontaneous combustion is also disclosed in U.S. Pat. No. 3,896,557 and involves the heating of the coal in a fluidized bed system with a combustion gas containing 7% to 9% of oxygen by volume to reduce the moisture level of the coal to an amount of from about 8% to about 12%.

Another technique for stabilizing lignitic coal is that disclosed in U.S. Pat. No. 3,723,079 where dried coal is treated with oxygen and then rehydrating the coal with water in the amount of from about 1.5% to about 6% by weight of the oxygen treated coal.

It has now been found that lignitic and subbituminous coal may be stabilized against spontaneous combustion by simply treating the dried coal with steam at a steam temperature of from 100° C. to about 115° C. so as to permit rehydration of the coal to a moisture level of from about 2% to about 10% by weight.

The coals used in the process of the invention will be, as indicated, lignitic and subbituminous coals and will include North Dakota lignite, Powder River subbituminous coal, Wyodak coal, and the like. Such coals usually contain from about 20 to 40 percent water as they come from the mine.

As indicated, the steam treatment is carried out on dried coal; e.g. coal having a moisture level of essentially zero percent. The coal may be dried by any conventional means and is not critical to the process of the invention. Preferably, however, the drying procedure will be carried out with a fluidized bed type dryer where the drying gas is used to fluidize the bed. A preferred type of dryer is the Parry Dryer referred to above. After the coal is dried it is simply subjected to the steam treatment which may be done easily by passing the steam through a bed of the coal. Alternatively, the steam may be passed into a rotating kiln containing the coal. Another technique is to simply place a steam seal at the exit of a moving bed dryer which enables the moving coal to pass through a wall of steam. The steam temperature should be at least 100° C. and not above about 115° C. for if it is too dry, the coal will not be rehydrated.

As indicated, steaming is continued until the coal is rehydrated to a moisture level of from about 2% to about 10% and this level is easily controlled by appropriate moisture analysis.

It is surprising that the process of the invention gives the stabilizing effect to the extent observed because rehydrating dried coal with liquid water does not produce the high degree of stabilization achieved by the invention.

In order to more fully exemplify the process of the invention the following examples are given:

EXAMPLE 1

Wyodak coal of one-fourth inch to 0 mesh containing about 30% moisture (inherent) was dried in a Parry Dryer. The temperature of the input gases was about 200° C. The dried coal was then subjected to steaming for fifteen minutes at a steam temperature of 100° C., after which time the moisture content of the coal was 7% by weight. The treated coal was subjected to a stability test carried out by placing the coal in a dewar flask fitted at the bottom with a sparging tube to pass oxygen through the coal and equipped with a temperature measuring device. The coal (450 g.) in Dewar flask (70 mm. I.D.) is about 200 mm. in depth and oxygen saturated with water is passed through it at 62° C. at a rate of 200 ml/min. The time for combustion of the coal to occur is noted as shown by the sudden temperature increase and is taken as a measure of stability. The results are shown in the following table together with controls and coal and related treating methods:

TABLE I

| Treatment | % $H_2O$ In Coal | Stability Test. (Hrs. Stable) |
|---|---|---|
| Dried coal | 0 | 0.7 |
| Steamed Dried coal | 7 | 7.8 |
| Add water to dried coal | 6 | 0.8 |
| Partially dried coal | 4 | 1.3 |
| Partially dried coal | 10 | 4.4 |
| Partially dried coal | 7 | 3.0 (estimated) |

Thus, it can be seen that the steamed coal is more than twice as stable as partially dried coal at the same moisture level. Further, it is evident that rehydrating dried coal with water to essentially the same moisture level imparts only slight stability to the coal.

EXAMPLE 2

This example shows that redrying the steamed coal destroys the stabilizing effect. Two samples of dried Wyodak coal as in Example 1 were steamed at 100° C. for (a) 1 hour and (b) 0.25 hour respectively and then redried to essentially zero percent moisture. The coal contained about 10% water before redrying. Table II indicates the results of stability tests on these samples.

TABLE II

| Sample | Stability Test (Hrs. Stable) |
|---|---|
| (a) | 0.8 |
| (b) | 0.8 |

The invention claimed is:

1. A process for stabilizing lignitic and subbituminous coal containing from about 25 to about 40% by weight water which comprises drying said coal to essentially zero percent moisture and subsequently treating said dried coal with steam at a temperature of from about 100° C. to about 115° C. so as to rehydrate said coal to a moisture level of from 2% to about 10% by weight, whereby said coal is stabilized against spontaneous combustion.

2. The process of claim 1 where the steam is at about 100° C. and the coal is rehydrated to a moisture level of about 7%.

3. The process of claim 2 where the coal is a subbituminous coal.

4. The process of claim 3 where the coal is Wyodak coal.

5. The process of claim 1 where the coal is lignite.

* * * * *